US011802387B2

(12) United States Patent
Schwichtenberg et al.

(10) Patent No.: US 11,802,387 B2
(45) Date of Patent: Oct. 31, 2023

(54) PET WASTE VACUUM AND CONTAINER

(71) Applicant: CURBICUS, INC., New York, NY (US)

(72) Inventors: Casey John Schwichtenberg, State College, PA (US); Anna Gannon, New York, NY (US)

(73) Assignee: CURBICUS, INC., New York, NY (US)

( * ) Notice: Subject to any disclaimer, the term of this patent is extended or adjusted under 35 U.S.C. 154(b) by 0 days.

(21) Appl. No.: 17/451,267

(22) Filed: Oct. 18, 2021

(65) Prior Publication Data

US 2023/0124073 A1 Apr. 20, 2023

(51) Int. Cl.

| | |
|---|---|
| ***E01H 1/12*** | (2006.01) |
| ***A47L 5/24*** | (2006.01) |
| ***E01H 1/08*** | (2006.01) |

(52) U.S. Cl.

CPC ..... *E01H 1/1206* (2013.01); *A47L 5/24* (2013.01); *E01H 1/0827* (2013.01); *E01H 2001/0881* (2013.01); *E01H 2001/1226* (2013.01); *E01H 2001/1273* (2013.01)

(58) Field of Classification Search

CPC ..... E01H 1/08; E01H 1/0827; E01H 1/0836; E01H 1/1206; E01H 1/1213; A47L 5/24; A47L 9/0666; A47L 9/10–127; A47L 9/14; A47L 9/1418; A47L 9/1481

USPC ..... 15/420, 422; 294/1.3

See application file for complete search history.

(56) References Cited

U.S. PATENT DOCUMENTS 3,430,843 A * 3/1969 Fesco ..... A47L 9/14 383/120
4,478,448 A * 10/1984 Albert ..... E01H 1/1206 294/1.4
4,478,488 A 10/1984 Albert
4,553,284 A * 11/1985 Strumbos ..... A47L 9/02 15/418
5,661,873 A 9/1997 Karet (Continued)

FOREIGN PATENT DOCUMENTS

DE 202005009487 U1 * 11/2005 ..... A47L 5/24
WO WO-9619935 A1 * 7/1996 ..... A47L 9/122

OTHER PUBLICATIONS

DE202005009487 PE2E Translation; Kilic, Cuma; Sep. 29, 2005. p. 1-5 (Year: 2005).*

(Continued)

*Primary Examiner* — Tom Rodgers
*Assistant Examiner* — Sidney D Hohl
(74) *Attorney, Agent, or Firm* — McKee, Voorhees & Sease, PLC

(57) ABSTRACT

A vacuum and container assembly is provided for collecting and disposing of dog poop. The vacuum includes a housing with an inlet tube or nozzle. The container assembly includes an outer sleeve and an inner flexible, air permeable bag. The sleeve is open at the rear end so as to fit over the vacuum nozzle, with the bag residing in the nozzle. The front end of the container assembly is temporary closed by flexible fingers. When the vacuum is turned on, the dog poop is suctioned past the fingers into the bag, without touching the vacuum housing or nozzle. The container assembly can then be removed from the nozzle and deposited in a waste receptacle for disposal.

19 Claims, 6 Drawing Sheets

(56) References Cited

U.S. PATENT DOCUMENTS

| | | | | |
|---|---|---|---|---|
| 6,116,194 | A * | 9/2000 | Komarnitskiy | E01H 1/1206 119/867 |
| 7,226,098 | B1 * | 6/2007 | Moreira | E01H 1/1206 294/1.4 |
| 9,974,282 | B2 | 5/2018 | Castano | |
| 11,739,483 | * | 8/2023 | Sabella | E01H 1/1206 294/1.3 |
| 2004/0194248 | A1 | 10/2004 | Holtz | |
| 2008/0030032 | A1 | 2/2008 | Gill | |
| 2009/0200812 | A1 | 8/2009 | Mambru | |
| 2010/0176611 | A1 | 7/2010 | Merino-Garcia | |
| 2012/0186037 | A1 | 7/2012 | Reynolds et al. | |
| 2014/0152031 | A1 | 6/2014 | Ballacchino | |
| 2014/0152033 | A1 | 6/2014 | Wilson | |
| 2014/0159398 | A1 | 6/2014 | Reynolds | |
| 2016/0369462 | A1 | 12/2016 | McFadden | |
| 2017/0037589 | A1 | 2/2017 | Rivadeneira | |
| 2017/0159254 | A1 | 6/2017 | Gordon | |
| 2018/0044869 | A1 * | 2/2018 | Rosa | E01H 1/1206 |
| 2020/0154965 | A1 | 5/2020 | Schwichtenberg et al. | |

OTHER PUBLICATIONS

WO9619935 PE2E Translation; Rader, Armin; Dec. 23, 1994, p. 1-4 (Year: 1994).*

* cited by examiner

PET WASTE VACUUM AND CONTAINER

FIELD OF THE INVENTION

The invention is directed to a vacuum and disposable container for picking up and disposing of dog waste.

BACKGROUND OF THE INVENTION

Dog owners and dog walkers have a responsibility to clean up after their dog defecates. This obligation to properly dispose of pet waste maintains a clean environment and prevents disease and pollution. The current methods of disposing of dog poop includes picking up the pet waste by handheld devices, such as a shovel or rake. This mechanical method does not allow the user to contain the waste neatly, nor transport the waste easily. Other methods include picking up the waste by hand using a plastic bag. However, plastic bags are a large source of pollution and do not decompose quickly or easily. Vacuums have been considered for sucking up the dog waste, but conventional vacuum bags and filters are not fit to properly handle the pet waste, which may enter the vacuum housing, causing failure of the motor or other electrical components. Vacuuming the waste also exposes the waste to the vacuum hose or nozzle, which then needs to be cleaned, which is an unpleasant job. Thus, there is a need for a simple, quick, and clean method for containing and disposing of dog poop.

Accordingly, a primary objective of the present invention is a provision of a dog poop vacuum for picking up dog poop easily and cleanly for proper disposal.

Another objective of the present invention is a method of vacuuming dog poop into a disposable bag, without subjecting the vacuum components to contact with the poop.

A further objective of the present invention is a provision of a vacuum for collecting dog waste into a container having a sleeve mounted over the vacuum inlet tube and an internal bag or compartment residing inside the inlet tube for receiving the dog waste.

Yet another objective of the present invention is the provision of a dog poop container which is in a collapsed, flat condition for storage and packaging, and which can be expanded to a tubular shape to fit over a vacuum nozzle or inlet.

Another objective of the present invention is a provision of a container for dog poop having an outer tubular sleeve and an inner, air-permeable bag with the container being mounted on a vacuum inlet tube so that suction from the vacuum can draw dog poop into the bag, without exposing the inlet tube or vacuum housing to the collected poop.

These and other objectives have become apparent from the following description of the invention.

SUMMARY OF THE INVENTION

A vacuum and container are provided for collecting and containing dog poop. The vacuum includes a housing with an internal motor, a battery, a handle, and electrical circuitry for actuating the motor to create a suction or vacuum inside the housing. The container includes an outer sleeve and an inner, flexible, air-permeable bag. The sleeve is designed to slide over the vacuum inlet nozzle, with the flexible bag extending into the nozzle. The front end of the nozzle is covered by the sleeve and/or bag.

In use, the vacuum is turned on, and the open end of the container is positioned near or over the dog poop, which is then sucked into the internal bag by the vacuum suction. At no time does the poop contact the vacuum housing or inlet tube. The sleeve with the attached bag containing the poop can then be slid off of the vacuum nozzle or inlet tube for disposal in a garbage can or other receptacle.

DETAILED DESCRIPTION OF THE APPLICATION

Figure 1:
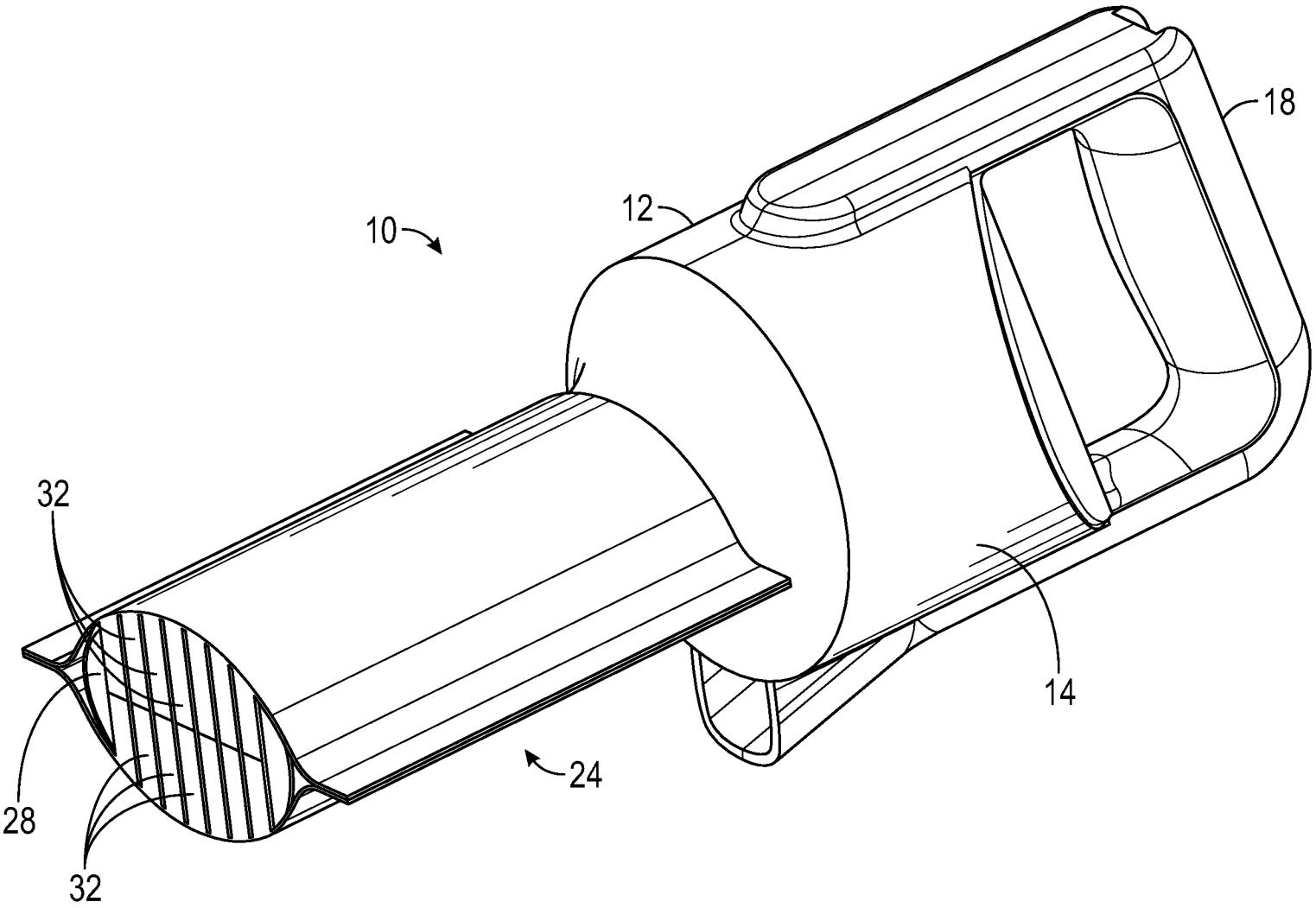
FIG. 1 is a perspective view of the dog poop vacuum and poop container, according to the present invention.
Figure 2:
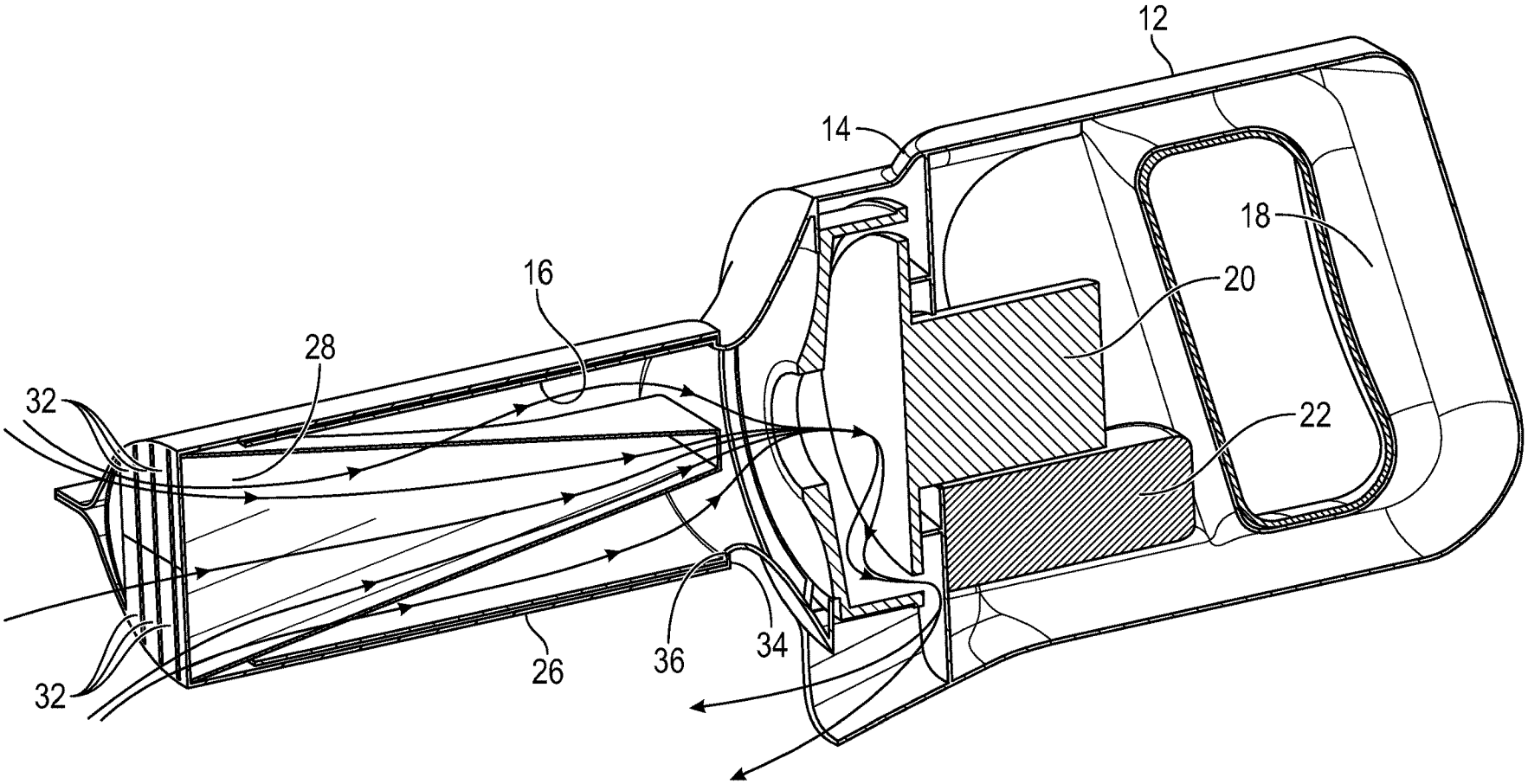
FIG. 2 is a sectional view taken along lines 2-2 of FIG. 1.

A dog poop collection device 10 includes a vacuum 12 with a housing 14, an inlet tube or nozzle 16, a handle 18, an internal electric motor 20, and a battery 22 for powering the motor. Electric circuitry, including an on/off switch, is provided for actuating the motor 20 to generate a vacuum through the path shown by the arrows in FIG. 2.

The device further includes a container assembly 24, comprising an outer sleeve 26 and an inner bag 28 inside the sleeve. The rear end of the sleeve 26 is open so as to be slidable over the vacuum inlet tube 16. The rear end of the bag 28 is closed. The front end of the bag 28 is open.

Figure 8:
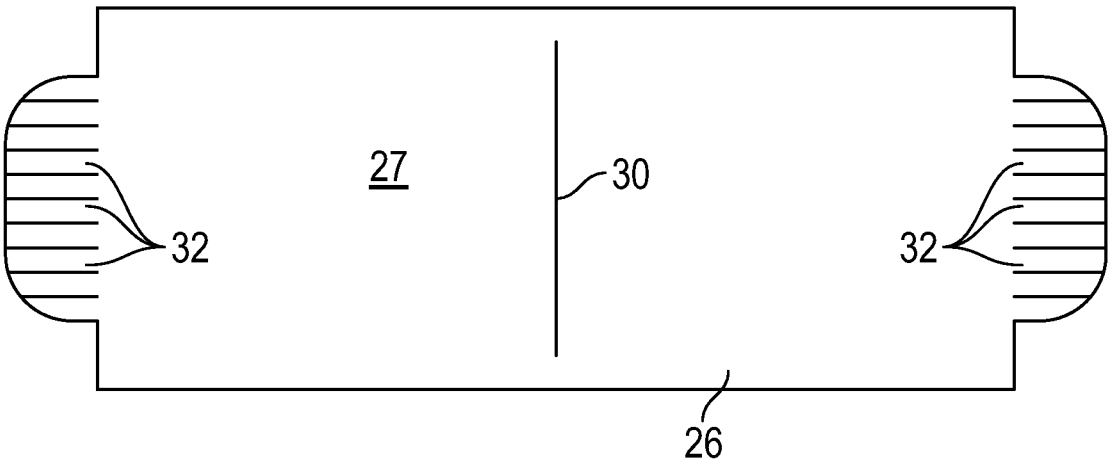
FIG. 8 is a plan view of the sleeve blank or cut out of the container assembly.
Figure 9:
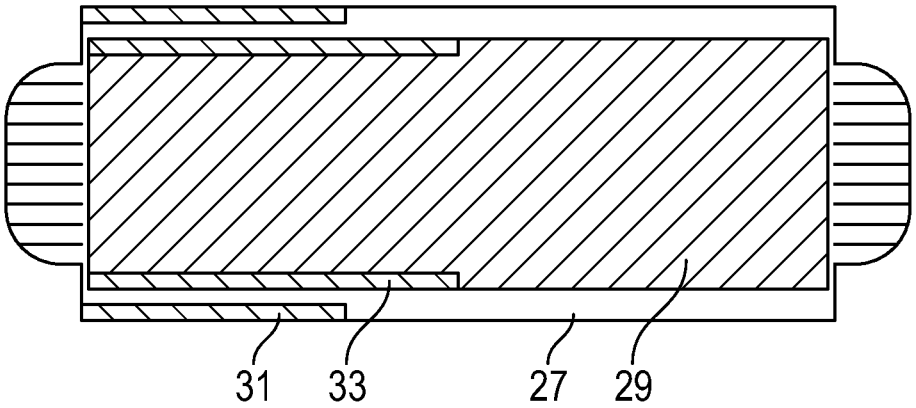
FIG. 9 is a plan view of one step of the assembly process for the collector bag assembly.
Figure 10:
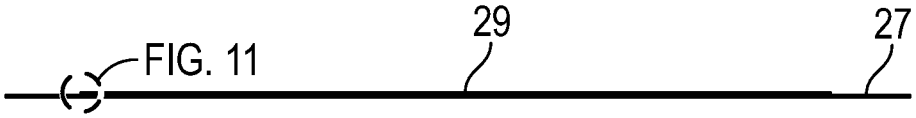
FIG. 10 is a side elevation view of the container assembly shown in FIG. 9.
Figure 11:
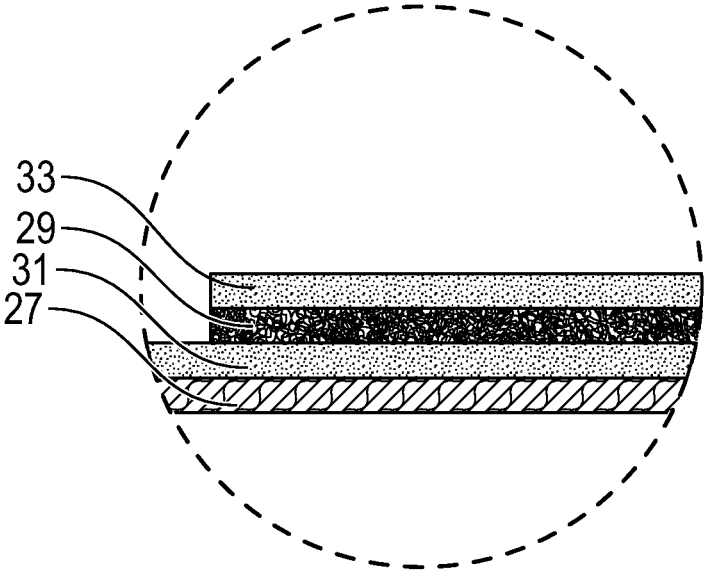
FIG. 11 is a sectional view taken along lines 11-11 of FIG. 10.
Figure 12A:
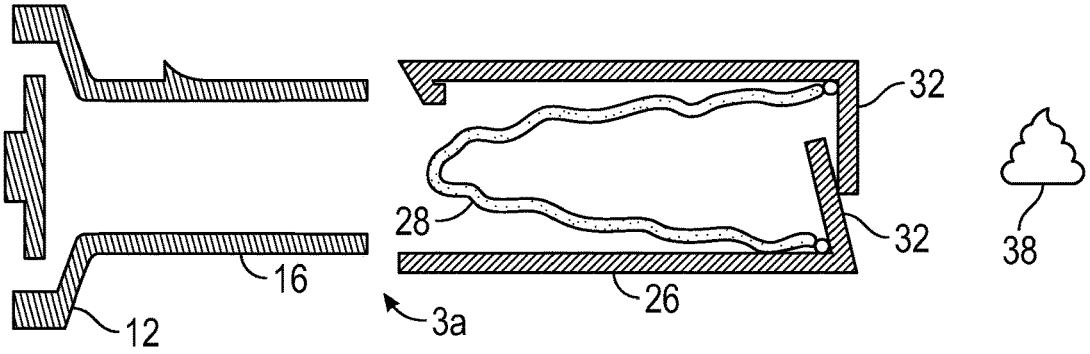
FIGS. 12A, 12B, and 12C illustrate a sequence of steps for collecting dog poop using the vacuum and collector assembly of the present invention.
Figure 12B:
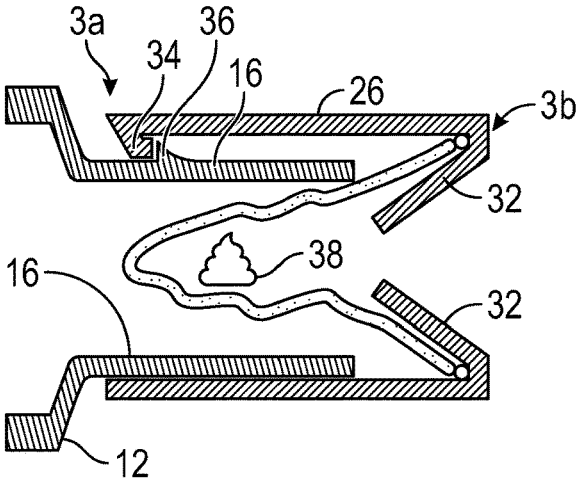
Figure 12C:
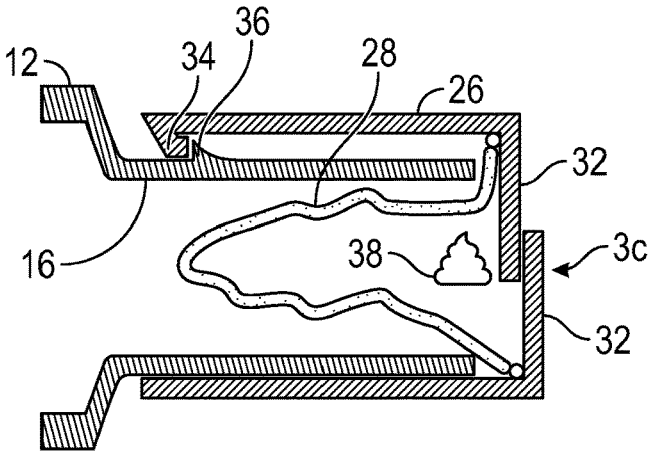

In the embodiment shown in the drawings, the sleeve 26 is formed from a sheet 27 of paper or other material having a center slit 30 (FIG. 8) extending substantially across the width of the sheet 27 but not to the opposite lateral side edges. Each end of the flat sheet 27 includes a semi-circular end with a plurality of fingers 32. The bag 28 initially is also flat sheet 29 of air permeable material, such as cotton, with the opposite ends of the sheet 29 adhered or otherwise attached to the opposite ends of the sheet 27 The sheets 27 and 29 are then folded over, along the axis of the slit 30, and the side edges of the sheet 27 are glued or otherwise attached, such as with adhesive 31, to form the sleeve 26 and the side edges of the sheet 29 are glued or otherwise attached, such as with adhesive 33 to form the bag 28. The container 24 formed from the sheets 37, 29 may remain in a flat condition for packaging and/or storage.

Figure 3:
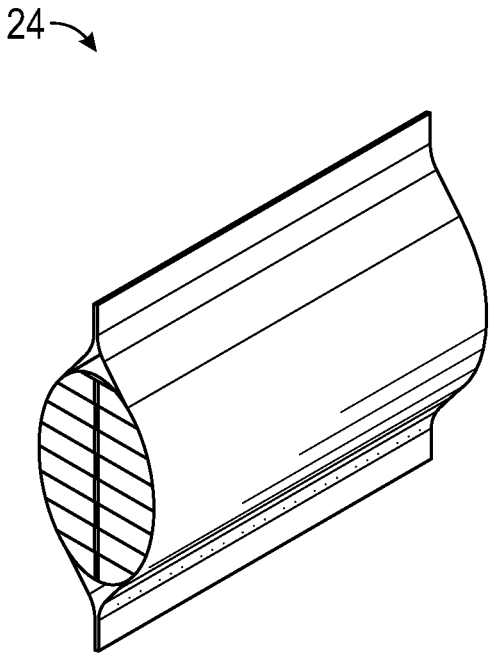
FIG. 3 is a front perspective view of the container assembly of the present invention.
Figure 4:
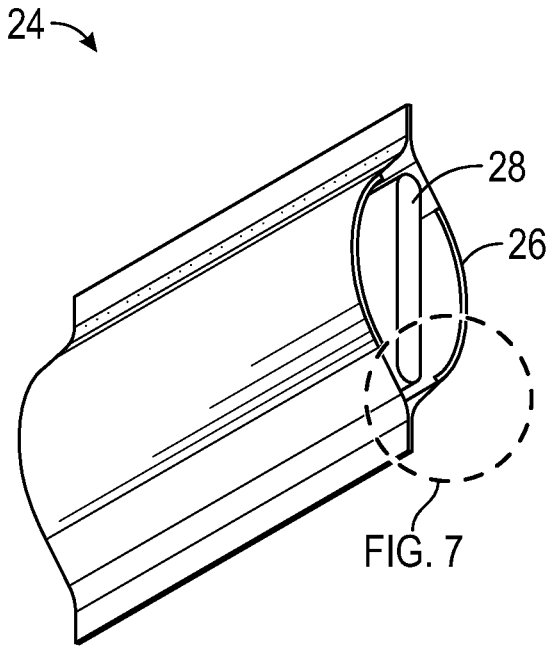
FIG. 4 is rear perspective view of the container assembly of the present invention.
Figure 5:
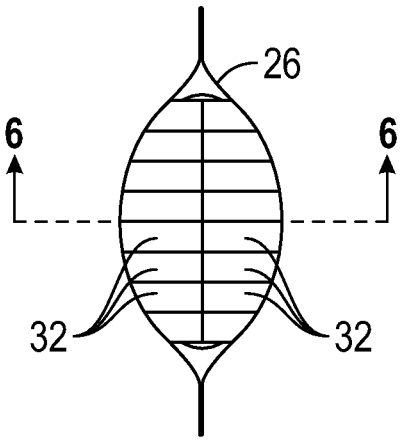
FIG. 5 is a front elevation view of the container assembly.
Figure 6:
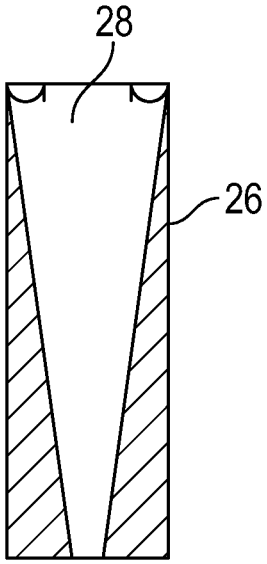
FIG. 6 is a sectional view taken along lines 6-6 of FIG. 5.
Figure 7:
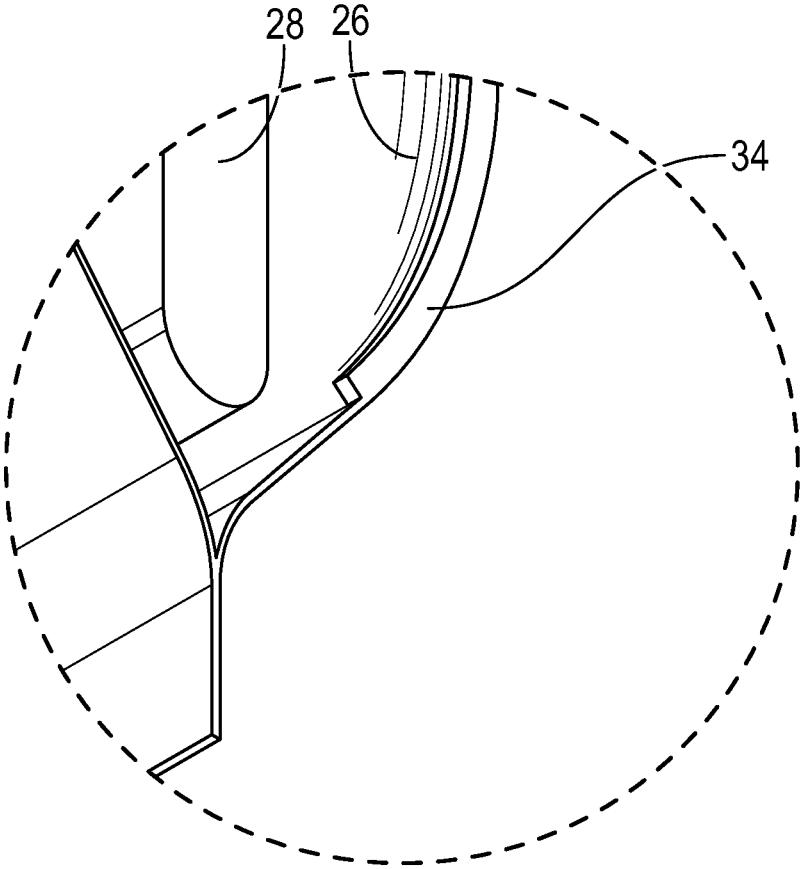
FIG. 7 is an enlarged perspective view of a rear portion of the container assembly.

In use, the flat container 24 can be manually squeezed at it opposite edges so as to form a tubular container, as shown in FIGS. 3 and 4. The tubular container 24 includes an open rear end, and the front end being closed by the fingers 32. The fingers may overlap one another, and do not need to remain parallel to one another. The tubular container 24 is then slid onto the vacuum tube or nozzle 16 so that the sleeve 26 resides around the tube or nozzle 16, while the bag 28 resides within the tube or nozzle 16. The front end of the container 24 covers the front end of the tube or nozzle 16. The vacuum can then be turned on, so that the motor 20 creates a vacuum drawing air inwardly through the nozzle 16. Preferably, the container 24 includes a flange 34 on the rear end, which overlappingly engages a lip 36 at the rear of the vacuum inlet tube or nozzle 16, so as to retain the container 24 on the tube or nozzle 16. Then, the opened end of the container 24 can be placed over or next to the dog poop 38, which will be suctioned upwardly into the bag 28 by the vacuum, passing through the flexible fingers 32. After the poop 38 passes beyond the fingers 32, the fingers will return, at least partially, towards their closed position, to retain the poop in the bag 28. When the dog owner or dog walker gets to a garbage or trash can, the container 24 can be slid off of the vacuum nozzle 16 in any convenient manner. In a preferred manner, the container 24 is removed without the dog owner or dog walker touching the container with their hand, but rather, simply positioning the container 24 over the trash or garbage can, with a rear edge of the container 24 engaging an upper inner edge of the can, and then withdrawing the vacuum away from the garbage or trash can. Alternatively, the dog owner or dog walker can pinch or grab one edge of the container 24 and slide the container off of the vacuum nozzle 16 for deposit into a trash or waste can.

The invention has been shown and described above with the preferred embodiments, and it is understood that many modifications, substitutions, and additions may be made which are within the intended spirit and scope of the invention. From the foregoing, it can be seen that the present invention accomplishes at least all of its stated objectives.

What is claimed is:

1. A container for collecting dog poop via a vacuum with an inlet tube having a length, comprising:

an air permeable bag adapted to fit inside the inlet tube, having a closed rear end through which a vacuum suction can be drawn and an open forward end extending forwardly beyond the inlet tube;

an outer sleeve connected to the forward end of the air permeable bag and extending substantially to the rear end of the air permeable bag so as to define a gap between the outer sleeve and the air permeable bag, the gap extending forwardly substantially from the rear end of the air permeable bag to the forward end of the air permeable bag so that the outer sleeve is mountable over the inlet tube while the air permeable bag resides inside the inlet tube, wherein the outer sleeve is longer than the length of the inlet tube;

wherein the air permeable bag and the outer sleeve are movable from a flat configuration for storage to a tubular configuration for use on the inlet tube;

wherein the air permeable bag is adapted to contain the dog poop vacuumed into the open forward end.

2. The container of claim 1, further comprising a flexible cover on a front end of the outer sleeve to allow dog poop to pass into the air permeable bag and prevent the dog poop from out of the air permeable bag.

3. The container of claim 2, wherein the flexible cover is integrally formed on the outer sleeve.

4. The container of claim 2, wherein the flexible cover includes a plurality of fingers.

5. The container of claim 4, wherein the fingers extend radially inwardly from the front end of the outer sleeve.

6. The container of claim 1, further comprising a flange on the outer sleeve to retentively engage the inlet tube to prevent the container from being accidentally detached from the inlet tube.

7. The container of claim 6, wherein the lip is resilient to allow the container to be detached from the inlet tube.

8. The container of claim 1, wherein the outer sleeve and the air permeable bag are compostable.

9. The container of claim 1, wherein the outer sleeve has an open rearward end.

10. The container of claim 1, wherein the air permeable bag and the outer sleeve are formed from first and second flat sheets of material, respectively.

11. The container of claim 1, wherein the air permeable bag and the outer sleeve each have opposite front and rear edges, and the air permeable bag and the outer sleeve are connected at the front edges and disconnected at the rear edges.

12. A vacuum for collecting dog poop, comprising:

a housing;

an electric motor inside the housing to create suction;

an inlet tube extending forwardly from the housing; a collapsible bag adapted to extend into the inlet tube;

a collapsible sleeve connected to the collapsible bag and adapted to cover an exterior of the inlet tube;

a flange extending laterally inwardly on an interior of the collapsible sleeve to overlappingly engage a laterally outwardly extending protrusion on an exterior of the inlet tube and thereby retain the collapsible sleeve on the inlet tube; and the collapsible sleeve having a forward end extending in front of the inlet tube.

13. The vacuum of claim 12, wherein the collapsible bag is air permeable.

14. The vacuum of claim 12, further comprising flexible fingers on a front end of the collapsible sleeve which allow the dog poop to pass inwardly into the collapsible bag but not outwardly from the collapsible bag.

15. The vacuum of claim 14, wherein the fingers and collapsible sleeve are formed as one piece.

16. The vacuum of claim 12, wherein the collapsible bag and the collapsible sleeve are joined to form a container movable from a flat storage configuration to a tubular use configuration.

17. The vacuum of claim 12, wherein the collapsible bag has an open forward end and a closed rear end, and the collapsible sleeve extends along the collapsible bag from the forward end to the rearward end.

18. The vacuum of claim 12, wherein the collapsible bag and the collapsible sleeve are each made from flat sheets of material.

19. The vacuum of claim 12, wherein the collapsible bag and the collapsible sleeve each have front edges and are joined at the front edges.

* * * * *